US005155456A

United States Patent [19]

Ruff et al.

[11] Patent Number: 5,155,456

[45] Date of Patent: Oct. 13, 1992

[54] MICROWAVE SWITCH ARRANGEMENT

[75] Inventors: Gerd Ruff, Heidelberg; Herbert Rubik, Mauer; Eckart Hettlage, Karlsruhe, all of Fed. Rep. of Germany

[73] Assignee: Teldix GmbH, Heidelberg, Fed. Rep. of Germany

[21] Appl. No.: 635,136

[22] PCT Filed: Jun. 7, 1989

[86] PCT No.: PCT/EP89/00638

§ 371 Date: Dec. 28, 1990

§ 102(e) Date: Dec. 28, 1990

[87] PCT Pub. No.: WO90/00316

PCT Pub. Date: Jan. 11, 1990

[30] Foreign Application Priority Data

Jun. 28, 1988 [DE] Fed. Rep. of Germany ..... 3821770

[51] Int. Cl.[5] ..... H01P 1/12

[52] U.S. Cl. ..... 333/106; 333/108

[58] Field of Search ..... 333/101, 106, 108; 200/504

[56] References Cited

U.S. PATENT DOCUMENTS

| | | | |
|---|---|---|---|
| 3,211,847 | 10/1965 | Johnson . | |
| 4,644,301 | 2/1987 | Hecht | 333/101 |
| 4,783,663 | 11/1988 | Rammos et al. | 343/778 |
| 4,829,271 | 5/1989 | Pitschi et al. | 333/105 |
| 4,945,320 | 7/1990 | Hettlage et al. | 333/106 |

FOREIGN PATENT DOCUMENTS

| | | | |
|---|---|---|---|
| 0211666 | 2/1987 | European Pat. Off. . | |
| 3704875 | 8/1987 | Fed. Rep. of Germany . | |
| 3638392 | 5/1988 | Fed. Rep. of Germany . | |
| 2582865 | 12/1986 | France . | |
| 2606556 | 5/1988 | France . | |
| 262501 | 11/1987 | Japan | 333/106 |
| 87/05155 | 8/1987 | PCT Int'l Appl. . | |
| 88/01444 | 2/1988 | PCT Int'l Appl. . | |

*Primary Examiner*—Paul Gensler

*Attorney, Agent, or Firm*—Spencer, Frank & Schneider

[57] ABSTRACT

A microwave switch arrangement for the selective connection of n input lines with n+ a output lines including m microwave switches, where m≧n, each including a rotor and a stator with at least two waveguide passages in the rotor and waveguide switch inputs and outputs in the stator, as well as waveguides for establishing interconnections between the microwave switches. The microwave switches are fastened to a carrier plate by means of respective waveguide flanges; waveguide connections, corresponding in their dimensions to the waveguide passages, are formed in the carrier plate; further waveguide connections extend at least in one plane parallel to the carrier plate; and selected of the microwave switch inputs and outputs are connected with the waveguide connections formed in the carrier plate, via the associated waveguide flanges, and with the further waveguide connections.

12 Claims, 7 Drawing Sheets

MICROWAVE SWITCH ARRANGEMENT

BACKGROUND OF THE INVENTION

This invention relates to a microwave switch arrangement for the selective connection of n input lines with n+a output lines including microwave switches ($m \geqq n$), with each of the switches having at least two waveguide passages in its rotor and having waveguide switch inputs and outputs in its stator, and waveguides for connecting the microwave switches.

Such microwave switch arrangements are disclosed, for example, in FIGS. 4 and 5 of German Offenlegungsschrift (published, unexamined application) 37 04 875, which is a counterpart to U.S. Pat. No. 4,945,320. The configuration of such microwave switches as internal waveguide switches is also disclosed in this laid-open patent application. The internal waveguide switch of this reference is provided with waveguide passages having reduced dimensions, particularly the smaller dimension of the waveguide cross section.

SUMMARY OF THE INVENTION

According to the present invention, a microwave switch arrangement of the initially mentioned type is provided wherein the microwave switches are all fastened to a carrier plate by waveguide flanges, and waveguide connections corresponding in their dimensions to the waveguide passages of the switches are formed in the carrier plate, and connected to an input or output of the respective switches. The solution according to the invention permits a particularly favorable configuration of a microwave switch arrangement, particularly if a large number of microwave switches are to be employed. The input and output lines to be connected may likewise be waveguide lines or also coaxial lines or part waveguide lines, part coaxial lines. Further advantages and features are defined in the dependent claims and will become evident from the description of the drawing figures.

BRIEF DESCRIPTION OF THE DRAWINGS

Embodiments of the invention will be described with reference to the drawing figures wherein.

DESCRIPTION OF THE PREFERRED EMBODIMENTS

Figure 1:
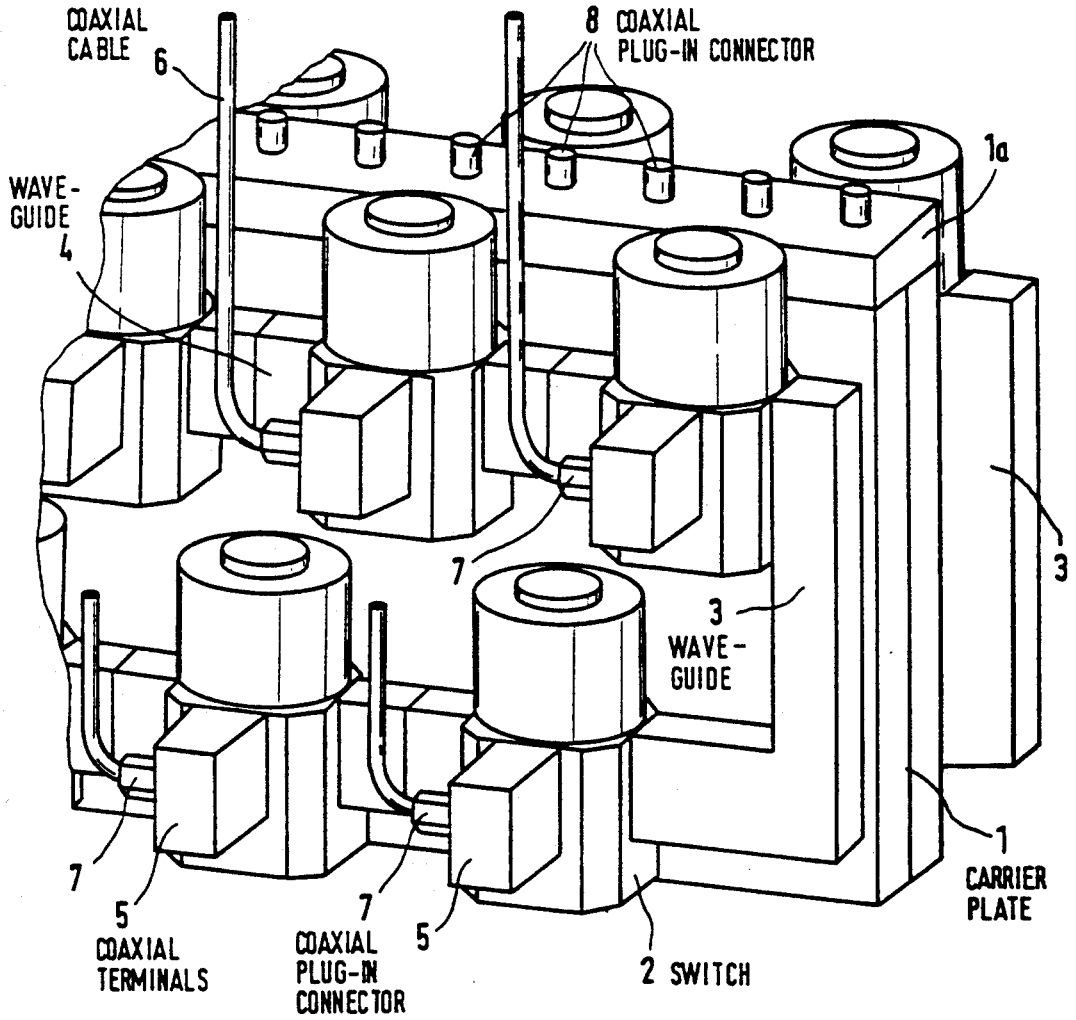
FIG. 1 is a perspective illustration of a section of a microwave switch arrangement according to the invention.

In FIG. 1, a carrier plate is designated 1 which in its interior is provided with waveguide connections in the required configuration. On both sides of this carrier plate 1, microwave switches 2 are fastened which are configured as internal waveguide switches, are interconnected by means of waveguides 3 and 4 and are provided with coaxial terminals 5 that are connected by means of plug-in connectors 7 with coaxial cables 6. The coaxial terminals 5 constitute adapters to the waveguides. At least one side, i.e., input/output port, of each of the microwave switches 2 is connected with a waveguide extending in the interior of the plate 1. At least some of these waveguides end in adapter chambers in a cover plate 1*a*. These chambers are connectable with coaxial lines by means of coaxial plug-in connectors 8.

Figure 2:
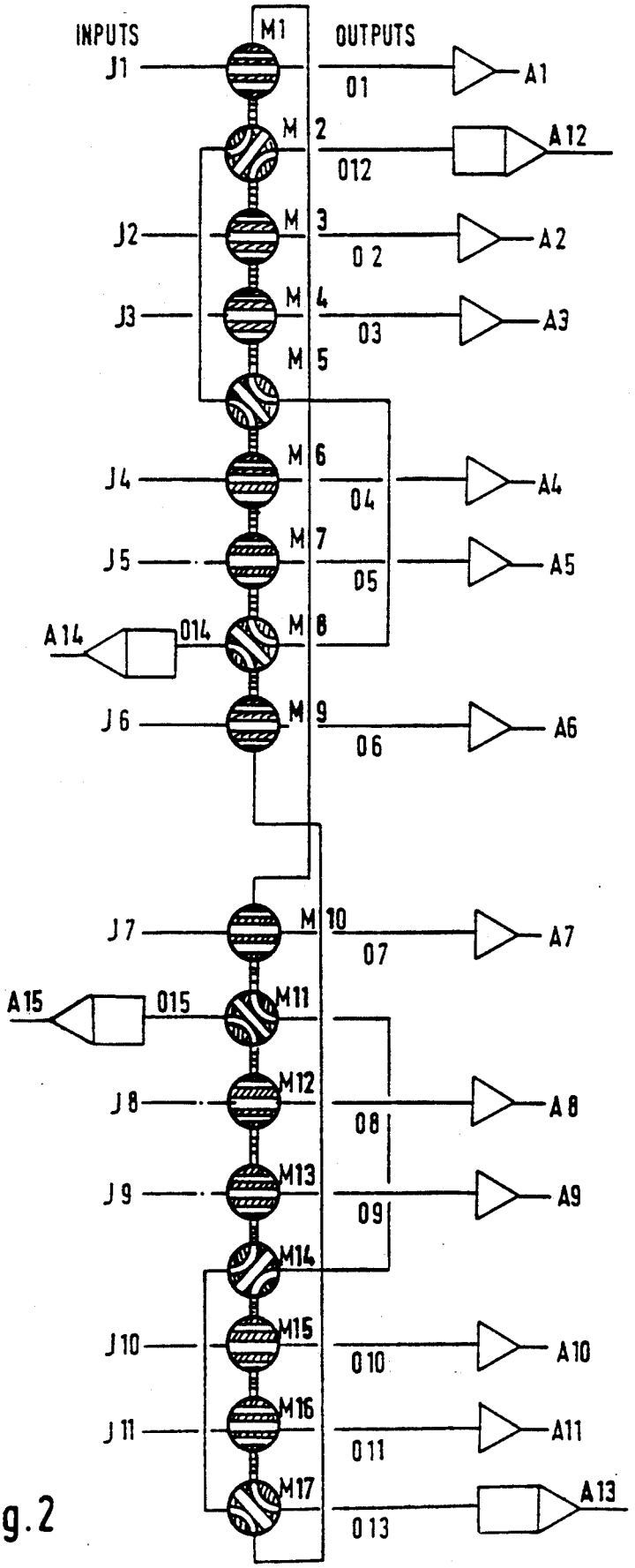
FIG. 2 shows a possible microwave switch arrangement in a schematic interconnected illustration.

FIG. 2 shows eleven coaxial inputs $J_1$ to $J_{11}$ which can be connected by means of microwave switches $M_1$ to $M_{17}$ with fifteen coaxial outputs $O_1$ to $O_{15}$. Outputs $O_1$ to $O_{15}$ lead to amplifiers $A_1$ to $A_{15}$. Four of these amplifiers are provided as substitute amplifiers $A_{12}$ to $A_{15}$ which are employed if one or several of the primary amplifiers are malfunctioning. Adjacently disposed microwave switches are interconnected by means of waveguide sections.

If, for example, amplifier $A_3$ were malfunctioning, actuation of switches $M_4$ and $M_8$ would switch input $J_3$ to substitute amplifier $A_{14}$. The arrangement permits a maximum of four switches to be connected in series.

Figure 3F:
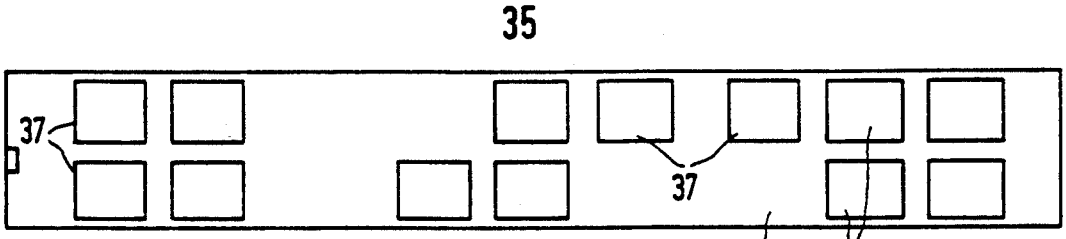
FIGS. 3*a*–3*f* show the possible configuration of a carrier plate.
Figure 3G:
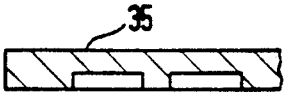
FIG. 3*g* is a partial longitudinal view of the partial plate of FIG. 3*f*, and FIGS. 4*a*–4*c* are views of a different microwave switch configuration.
Figure 3E:
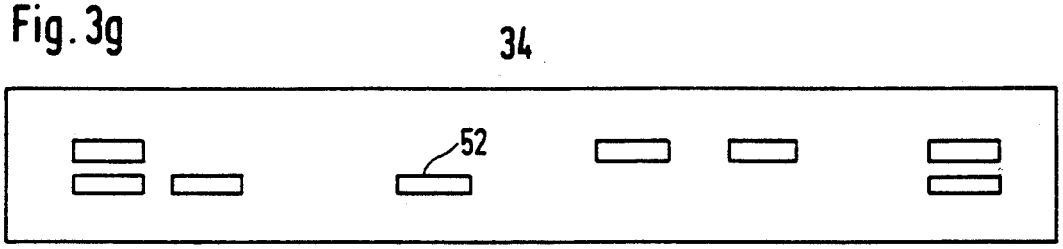
Figure 3A:
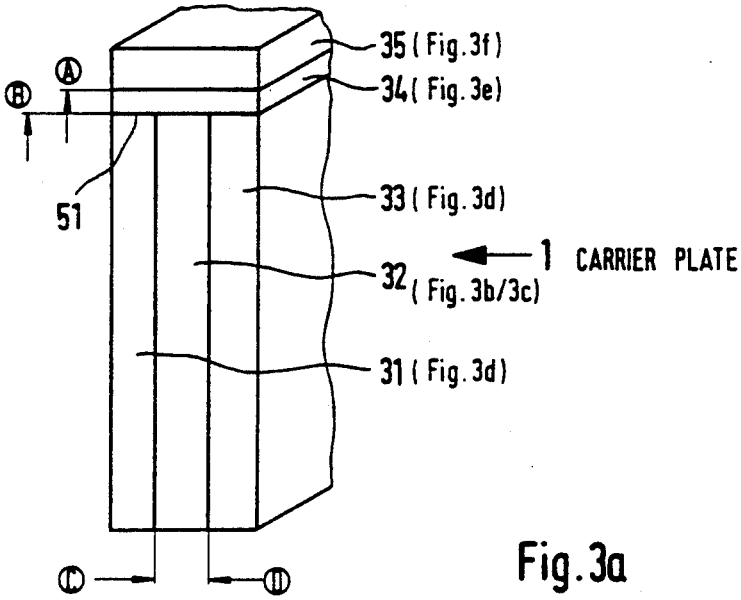

FIG. 3*a* shows the principle of the configuration of the carrier plate 1. It is composed of partial plates 31 to 33 and cover plates 34 and 35. A side view of plate 32, namely viewed in direction C and in direction D as well as the associated sectional views are shown respectively in FIGS. 3*b* and 3*c*.

Figure 3B:
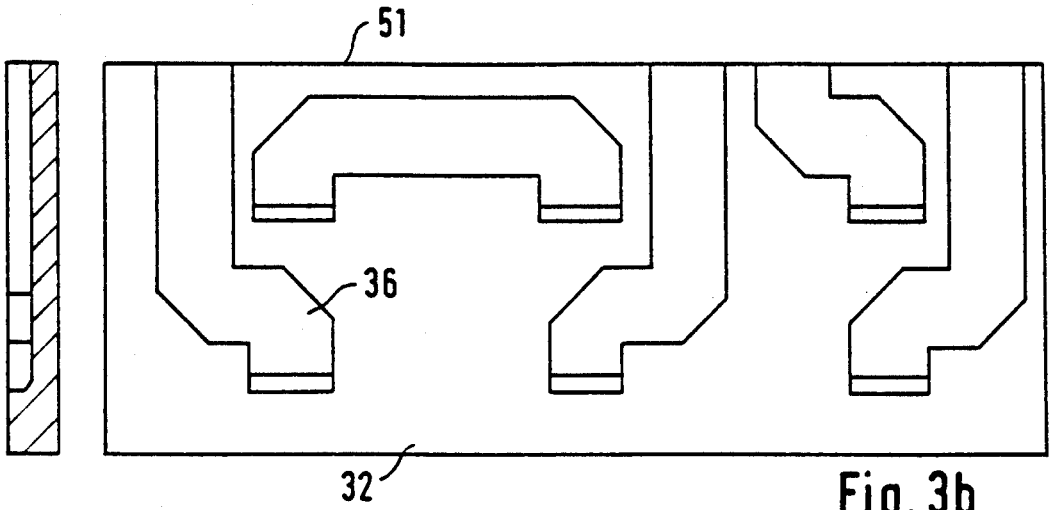
Figure 3C:
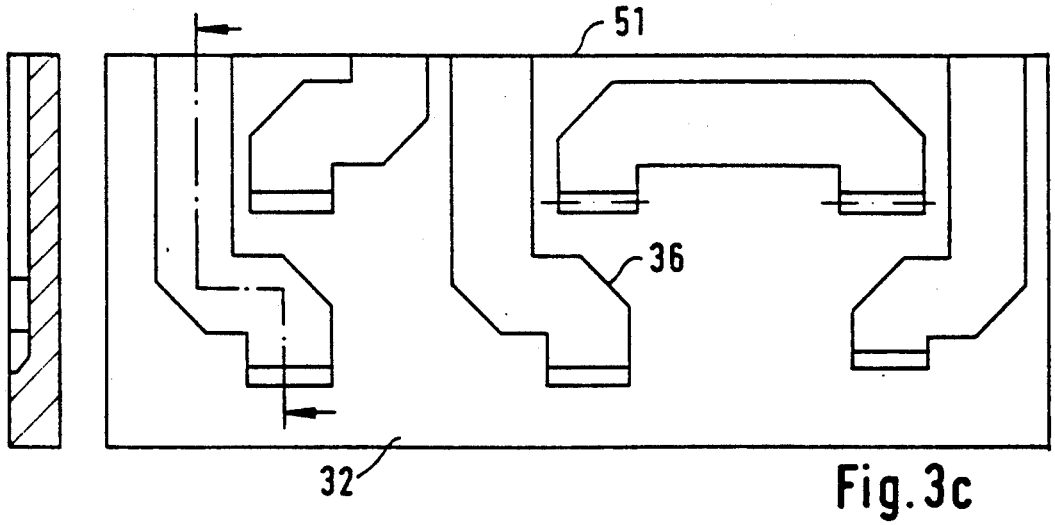
Figure 3D:
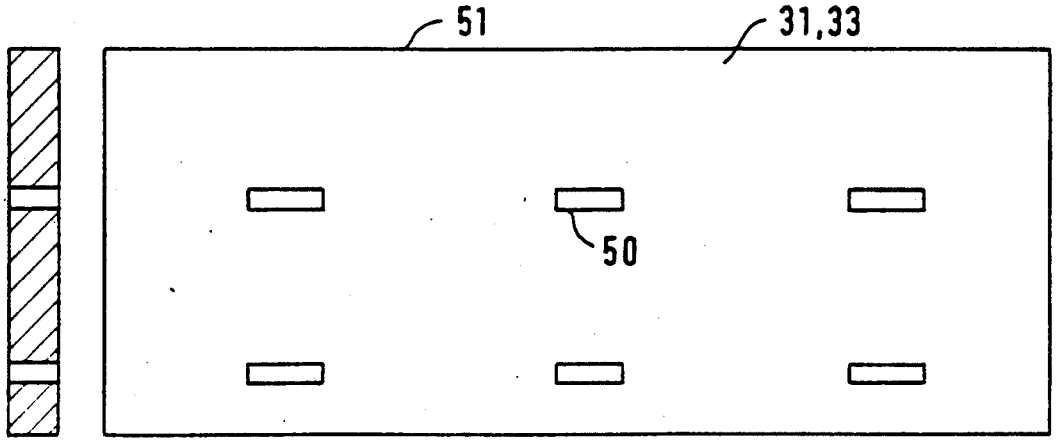

In the embodiment as shown in FIGS. 3*b* and 3*c*, a plurality of recesses 36 (five as shown) are made in each surface of plate 32. If cover plates 31 and 33, respectively, which are each configured as shown in FIG. 3*d*, are placed onto the respective surfaces of plate 32, plates 31 to 33 together form waveguides (ten in total) which are brought laterally through cover plates 31 and 33 via openings 50 at a total of twelve locations i.e. six on each side. This is where the respective waveguide terminals or flanges of the microwave switches 2 are connected. Several of the waveguides 36 are also brought or extended to the upper edge 51 of plates 31 to 33. The recesses 58 in cover plate 34, configured as shown in FIG. 3*e* (as seen in direction B of FIG. 3*a*), form extensions of these extended waveguides which are connected to adapter chambers 37 in the bottom surface of cover plate 35 (see FIG. 3*f*) into which then project the adapters connected with the plug-in connectors 8.

Cover plate 35 is additionally provided with connecting waveguides 38 which are brought or extended to its edge and may be connected with microwave switches that are fastened to the upper edge of the overall carrier plate 1. These connecting waveguides 38 may also be connected with an input or output by way of adapters and plug-in connectors.

Figure 4A:
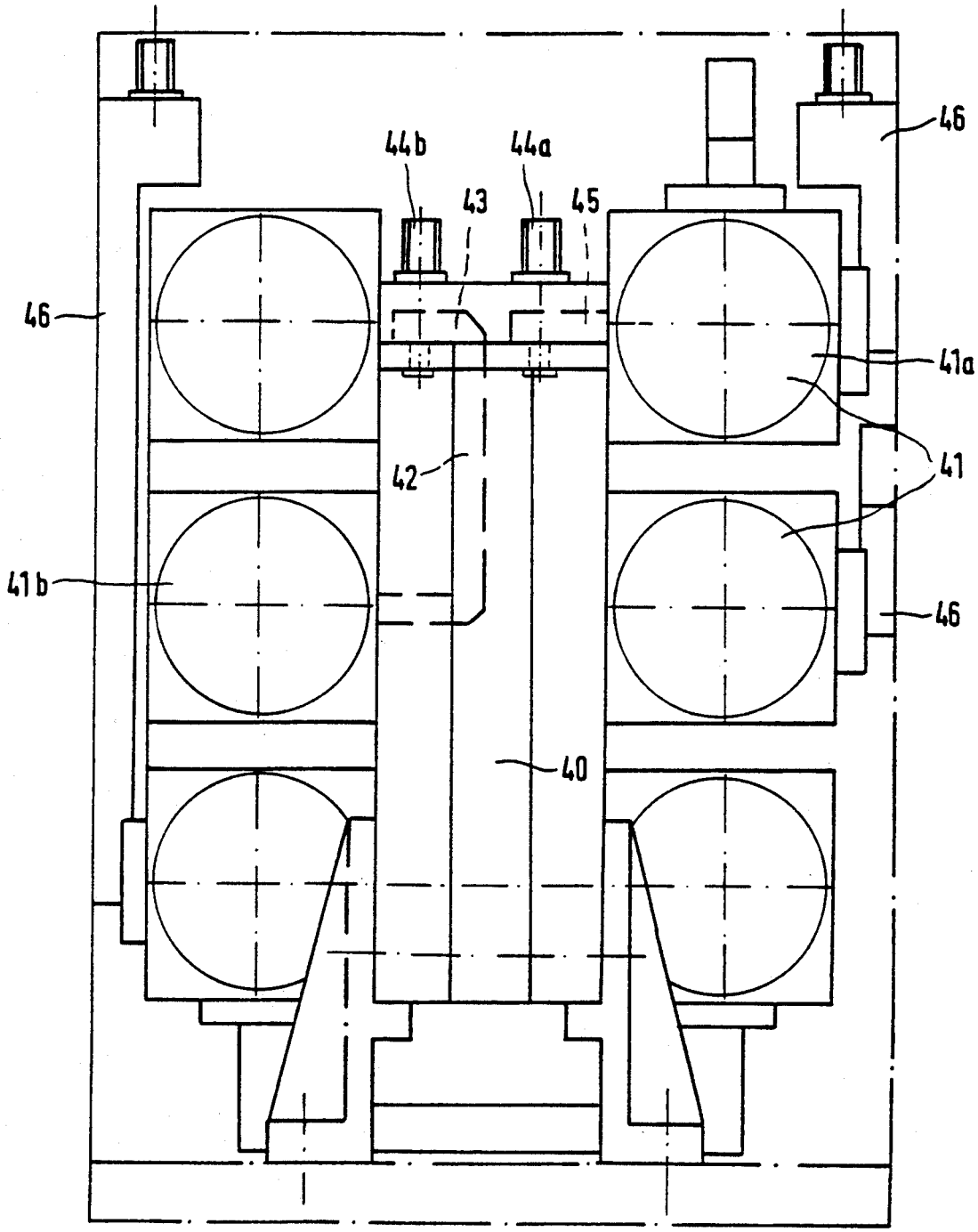

This can be seen in FIG. 4*a* which is a view toward the narrow side of a microwave switch arrangement. The three-part carrier plate is designated 40, the switches fastened thereon are designated 41. Here, such a connecting waveguide 45 changes from the output of microwave switch 41*a* to an adapter chamber which is connected with plug-in connector 44*a* by way of the adapter. An additionally indicated waveguide connection 42 connects switch 41*b* with an adapter chamber 43 which is connected with a coaxial plug-in connector 44*b* by way of an adapter. In planes parallel to plate 40, further connecting waveguides 46 are shown some of which are connected with the coaxial plug-in connector by way of adapters.

Figure 4B:
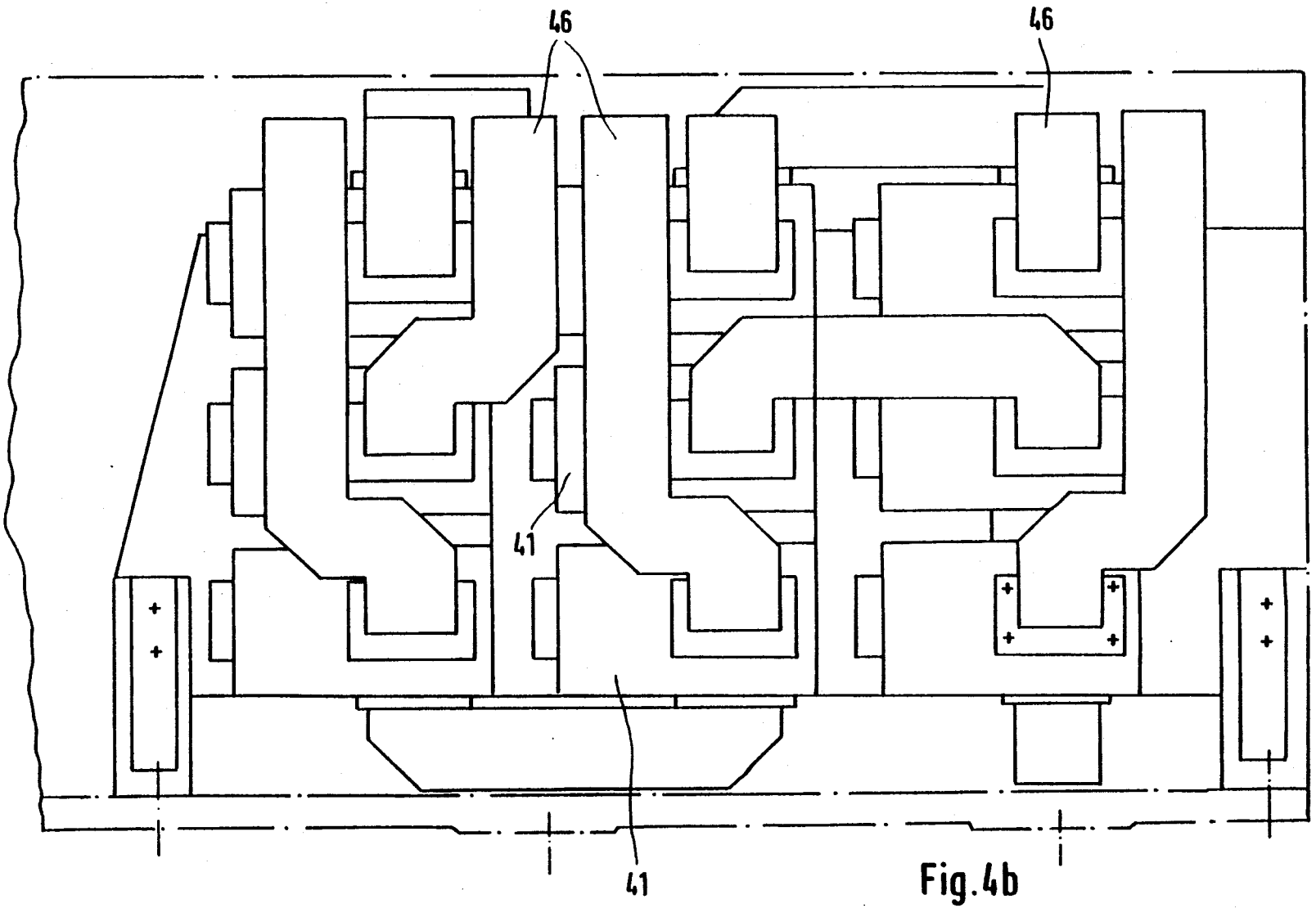

FIG. 4*b* is a side view of this microwave switch arrangement, with microwave switches 41 and the additional connecting waveguides 46 here being visible.

Figure 4C:
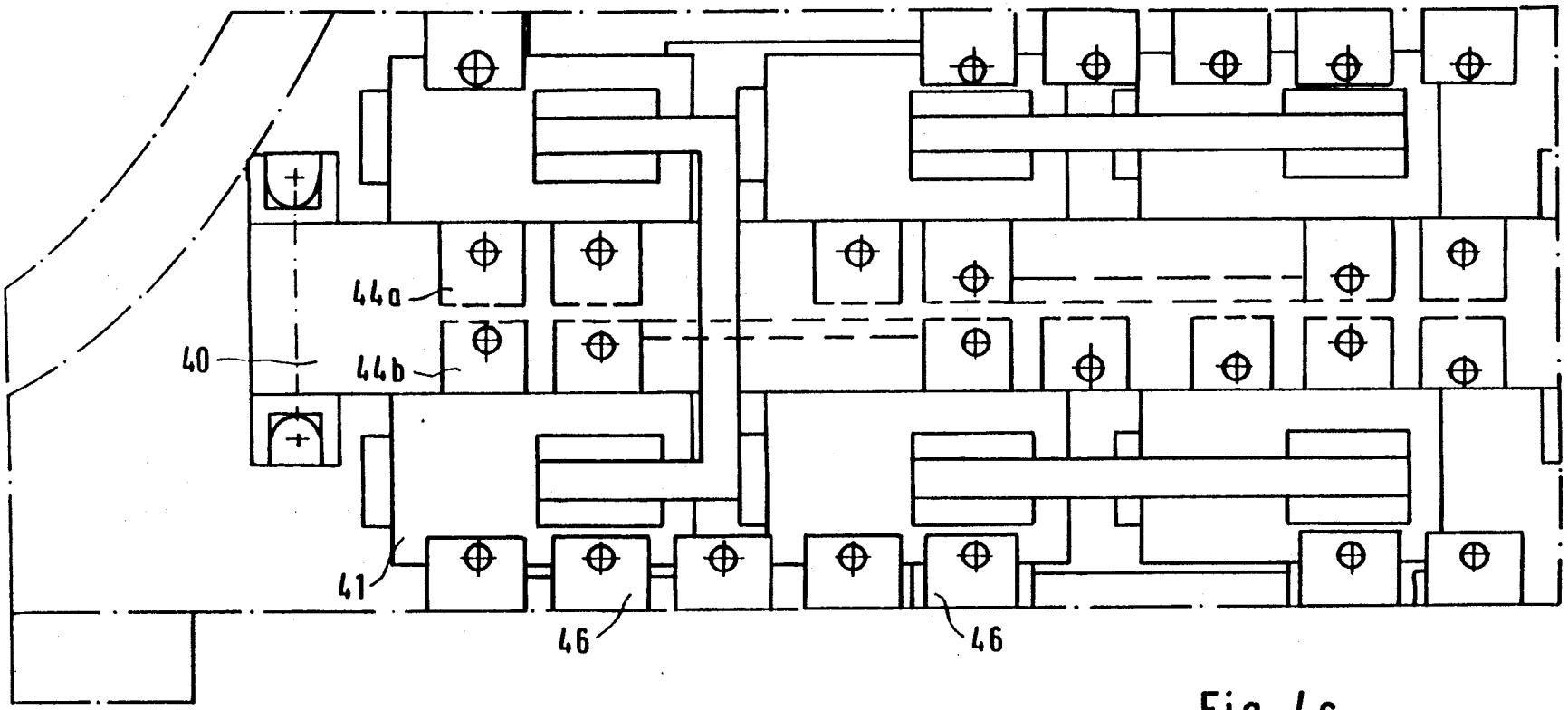

FIG. 4*c* is a front view of carrier plate 40 equipped with plug-in connectors 44*a* and 44*b* and the additional connecting conductors.

We claim:

1. In a microwave switch arrangement for the selective connection of n input lines with n+a output lines including m microwave switches, where m≧n, with each switch including a rotor and a stator with at least two waveguide passages in the rotor and waveguide switch inputs and outupts in the stator, as well as waveguides for establishing inter-connections between the microwave switches the improvement wherein: said microwave switches are fastened to a carrier plate by means of respective waveguide flanges; waveguide connections, corresponding in their dimensions to the waveguide passages are formed in the carrier plate; further waveguide connections extend at least in one plane parallel to the carrier plate; and selected ones of said microwave switch inputs and outputs are connected with the waveguide connections formed in the carrier plate via the associated waveguide flanges and with the further waveguide connections.

2. A microwave switch arrangement according to claim 1, wherein at at least one end face of the carrier plate, at least some of the input and output lines are connected with the waveguide connections which have been brought to the end face of said carrier plate.

3. A microwave switch arrangement according to claim 1, wherein said carrier plate is composed of at least two plates, with the waveguide connections being formed on the surface of at least one plate and the other plate in each case serving as a cover plate.

4. A microwave switch arrangement according to claim 1, wherein at least part of the input and output lines are waveguide lines.

5. A microwave switch arrangement according to claim 1, wherein at least part of the input and output lines are coaxial lines and said coaxial lines are connected byway of adapters with the waveguide switch inputs and outputs.

6. In a microwave switch arrangement for the selective connection of n input lines to a greater number of output lines, said arrangement including m microwave rotary switches, where m≧n, with each switch having a rotor with at least two waveguide passages and a stator with a plurality of input/output ports, and waveguides for establishing connections between respective input/output ports or the microwave switches, and wherein each of said input lines and each of said output lines is connected to a respective input/output port of a respective one of said switches; the improvement comprising:

a carrier plate having a plurality of waveguides with dimensions corresponding to said waveguide passages formed therein, each of said waveguide switches being mounted on said carrier via a microwave flange such that one input/output port is connected to a waveguide in said carrier plate and with at least some of said waveguides forming a portion of said waveguides serving to establish interconnections between respective input/output ports of the microwave switches; and further waveguides extending at least in a plane parallel to said carrier plate and form a further portion of said waveguides serving to establish interconnections between respective input/output ports of the microwave switches.

7. A microwave switch arrangement according to claim 6 wherein at least one end of each of said waveguides formed in said carrier plate extends to a side surface of said carrier plate and said waveguide switches are mounted on said side surface.

8. A microwave switch arrangement according to claim 7 wherein some of said at least one end of each of said waveguides extends to one side surface and some of said at least one end of each of said waveguides extend to the opposite side surface of said carrier plate; and said waveguide switches are mounted on both of said side surfaces.

9. A microwave switch arrangement according to claim 7 wherein at least some of said waveguides formed in said carrier plate extend to an edge surface of said carrier plate and are connected to respective ones of at least some of said input and output lines at said edge surface.

10. A microwave switch arrangement according to claim 6 wherein said carrier plate is composed of at least two plates, with the waveguides being formed by respective recesses in at least one surface of at least one of said plates and covered by the other of said plates.

11. A microwave switch arrangement according to claim 6 wherein at least part of said input and output lines are waveguide lines.

12. A microwave switch arrangement according to claim 6 wherein at least part of said input and output lines are coaxial lines which are connected via adapters with the respective said waveguide switch input/output ports.

* * * * *